United States Patent [19]

Weir

[11] 4,125,256

[45] Nov. 14, 1978

[54] SPRING BIASED SWING BOARD FOR PROJECTING A DIVER

[75] Inventor: Dean H. Weir, Walpole, Mass.

[73] Assignee: Raymond Lee Organization, Inc., New York, N.Y.

[21] Appl. No.: 791,386

[22] Filed: Apr. 27, 1977

[51] Int. Cl.[2] ..... A63B 5/10

[52] U.S. Cl. ..... 272/66; 124/36; 124/7

[58] Field of Search ..... 124/7, 6, 36, 41 R; 272/65, 66

[56] References Cited

U.S. PATENT DOCUMENTS

| | | | |
|---|---|---|---|
| 774,017 | 11/1904 | Wulff | 124/7 |
| 2,834,331 | 5/1958 | Cowie | 124/7 |
| 3,373,990 | 3/1968 | Riniker | 272/66 |

*Primary Examiner*—Richard C. Pinkham
*Assistant Examiner*—William R. Browne
*Attorney, Agent, or Firm*—Stephen Wyden

[57] ABSTRACT

A pipe frame has a catapult platform attached to catapult arms which is springingly connected to the frame and the hold down mechanism has a detente which engages the platform when a user stands on the platform. The platform will tilt forwardly when a user moves forward on the platform causing the detente to release and permitting the user to be catapulted off the platform into a body of water.

7 Claims, 4 Drawing Figures

SPRING BIASED SWING BOARD FOR PROJECTING A DIVER

I have invented a new and novel automatic diving platform. My device can be used to catapult a diver from a beach into a body of water such as an ocean, thereby increasing the frequency with which a swimmer can go into the water by reducing the time of the trauma of contact with the water to a minimum in an interesting and exciting way.

My invention can be understood in view of the accompanying figures.

Figure 1:
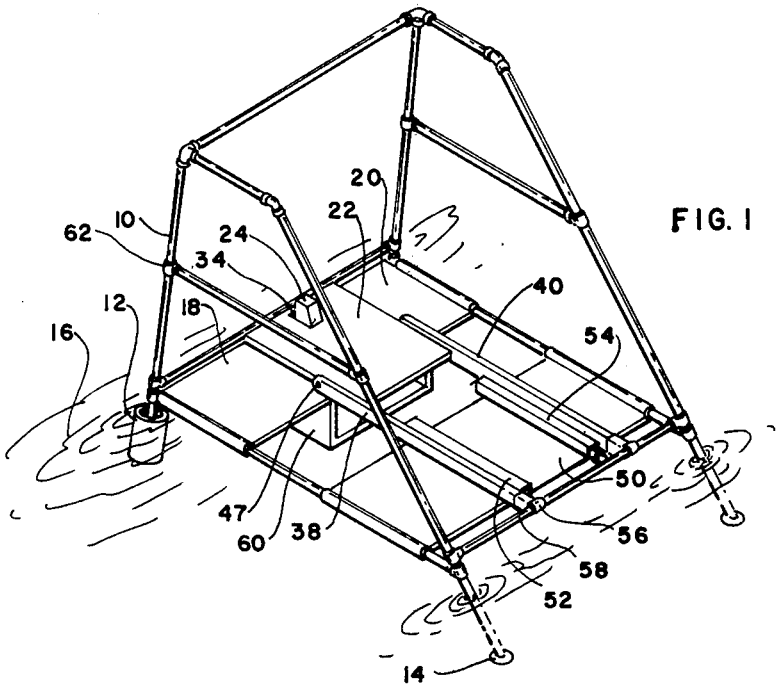
FIG. 1 is a perspective view of the device ready for use.
Figure 2:
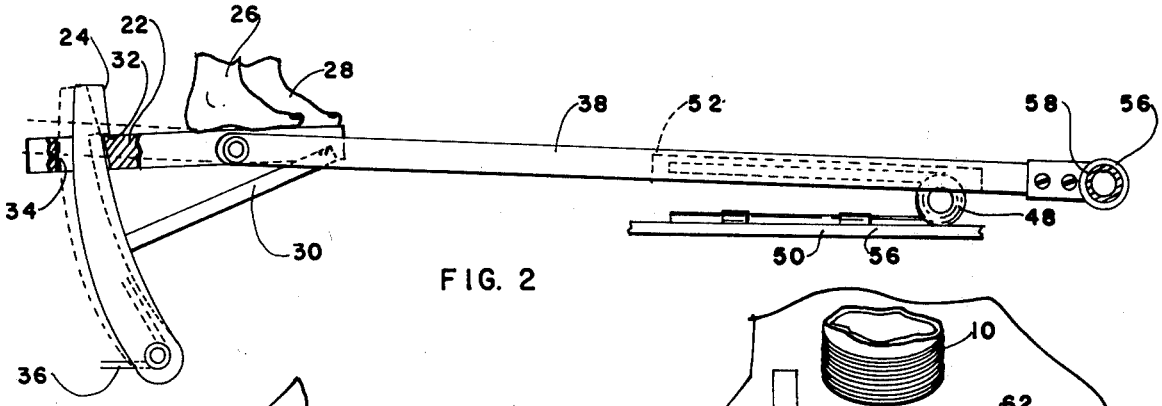
FIG. 2 is a side view in section of the device showing the device in use.
Figure 3:
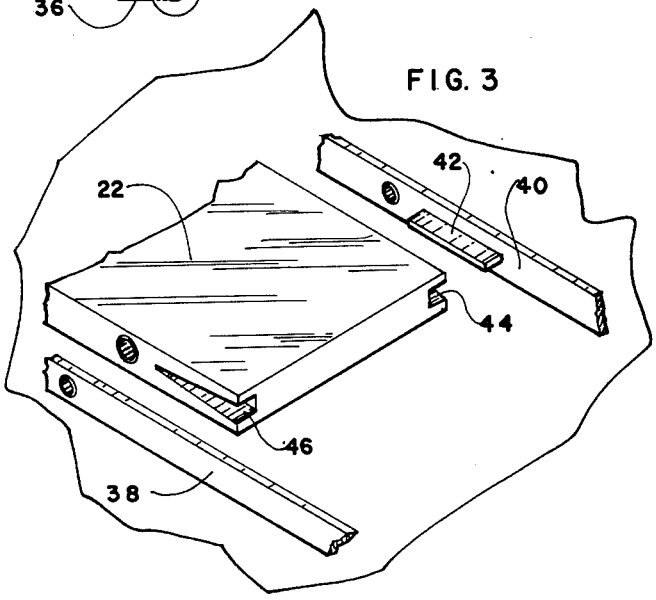
FIG. 3 is a closeup exploded view of the attachment of the platform to the support members.
Figure 4:
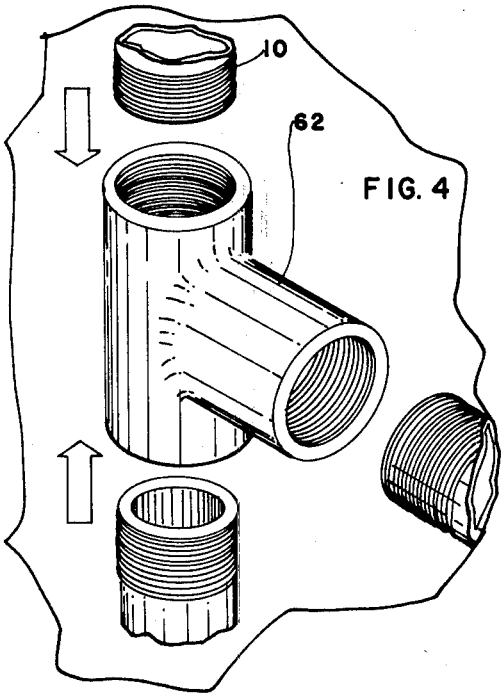
FIG. 4 is an exploded view of the connections between some of the pipes with some of the joints used in forming the device.

With regard to FIGS. 1, 2, 3, and 4, a frame 10 can have the rear legs of the frame 10 mounted on weighted supports 12 and by pads 14 at the front of the frame 10 so that the rear of the frame 10 will be well anchored when the frame 10 is resting in the water 16 and during use. A set of stationary foot rests 18 and 20 mounted at the rear of the lower portion of the frame 10 can hold the user before the user begins the diving operation. A catapulting platform 22 can engage a hold down 24 when a user's feet 26 and 28 press on the platform 22 pressing a pivoted rigid member 30 and causing a detente 32 of the latch 24 to engage the edge of the slot 34 within which the latch 24 moves while another spring 36 presses the latch 24 against the side of the slot 34. The spring 36 is attached to the frame 10 a set of catapulting arms 38 and 40 have tongue pieces 42 attached to their interior surfaces to engage grooves such as 44 and 46 in the catapulting platform 22 which is also pivotably attached 47 to the arms 38 and 40. A second spring 48 is attached to the front platform 50 and is pressingly engageable with a set of angle iron spring cap restraints 52 and 54 attached to the front interior surface of the catapult arms 38 and 40 while sleeves 56 attached the front end of the arms 38 and 40 to the front frame member 58 so that as the feet of the user 26 and 28 are moved forward past the pivot point 47 the platform 22 which has moved down into the supportive recess 60 may be released from the detente 32 in the hold down 24 permitting the catapult platform 22 to rise driving the user into the water 16. The sections of the frame 10 can be connected threadingly to pipe connectors 62 to form the frame and also to permit the rapid disassembly of the frame so that the automatic diving platform may be disassembled for storage and transport between uses. Having described a preferred embodiment of my invention, it is understood that various changes can be made without departing from the spirit of my invention, and, I desire to cover by the appended claims all such modifications as fall within the true spirit and scope of my invention .

What I claim and seek to secure by Letters Patent is:

1. An automatic diving platform, comprising:

a frame, a catapulting arm attached to the frame and having a free end, a platform attached to the free end of the cataputing arm, a hold down means attached to the frame and releaseably engageable with the platform, said hold down means being connected to the frame and releasably engageable with the platform, said platform being biased upwardly upon release from the hold down means, the hold down means having a detente, the detente releaseably engages the platform, the platform having a slot passing therethrough, said hold down means passing through the slot, said hold down means being released from the platform in response to a change of position of a user on the platform, and a spring attached to a front end of the frame which resiliently biases the catapult arm upwardly, whereby the catapult arm may be resiliently constrained in an upward position.

2. The platform of claim 1, further comprising a spring cap restraint attached to the catapult arm and engageable with the catapult spring.

3. The platform of claim 2, further comprising an underframe attachable to the rear of the platform and mounted under the platform whereby the platform may be supported in water.

4. The platform of claim 3, further comprising: a set of weighted anchors attached to the lower rear portion of the frame and a set of flat pads attached to a bottom of the front end of the frame.

5. The platform of claim 4, further comprising a tongue is attached to an interior surface of the catapult arm, and the platform has a groove engageable with the tongue.

6. The platform of claim 5, wherein the frame is made of pipe sections.

7. The platform of claim 6, wherein the sections of pipe are threadingly connected together by connectors, whereby the automatic diving platform may be disassembled for transportation between uses and for storage.

* * * * *